US006029284A

United States Patent [19]

Kawashima et al.

[11] Patent Number: 6,029,284

[45] Date of Patent: Feb. 29, 2000

[54] SWIMMING GOGGLES

[75] Inventors: Haruo Kawashima; Shoji Fujiwara; Shunji Fukasawa, all of Tokyo, Japan

[73] Assignee: Tabata Co., Ltd., Tokyo, Japan

[21] Appl. No.: 09/168,434

[22] Filed: Oct. 7, 1998

[30] Foreign Application Priority Data

Oct. 7, 1997 [JP] Japan ..... 9-274826

[51] Int. Cl.[7] ..... A61F 9/02

[52] U.S. Cl. ..... 2/428

[58] Field of Search ..... 2/428, 430, 445, 2/452, 426, 440, 439

[56] References Cited

U.S. PATENT DOCUMENTS 5,581,822 12/1996 Tagyo ..... 2/428

5,802,620 9/1998 Chiang ..... 2/428

5,857,221 1/1999 Geneve et al. ..... 2/428

FOREIGN PATENT DOCUMENTS 6-48715 7/1994 Japan .

*Primary Examiner*—Peter Nerbun

*Attorney, Agent, or Firm*—Lowe Hauptman Gopstein Gilman & Berner

[57] ABSTRACT

A peripheral wall of a lens member in swimming goggles is gradually thickened rearward from a front lens so that the peripheral wall has a height extending beyond a top of a flange of the lens member and a first groove extending along the flange is formed. A second groove of a cushion pad is engaged with an entire periphery of the flange so that the pad is exposed at an outer end (A) of the lens member.

4 Claims, 3 Drawing Sheets

FIG.4
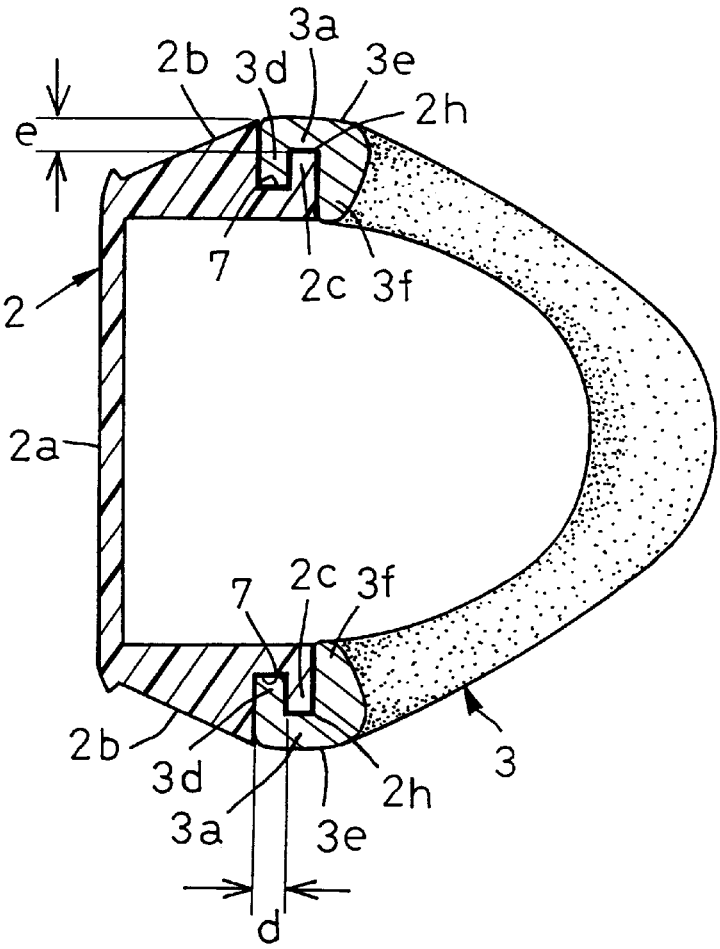
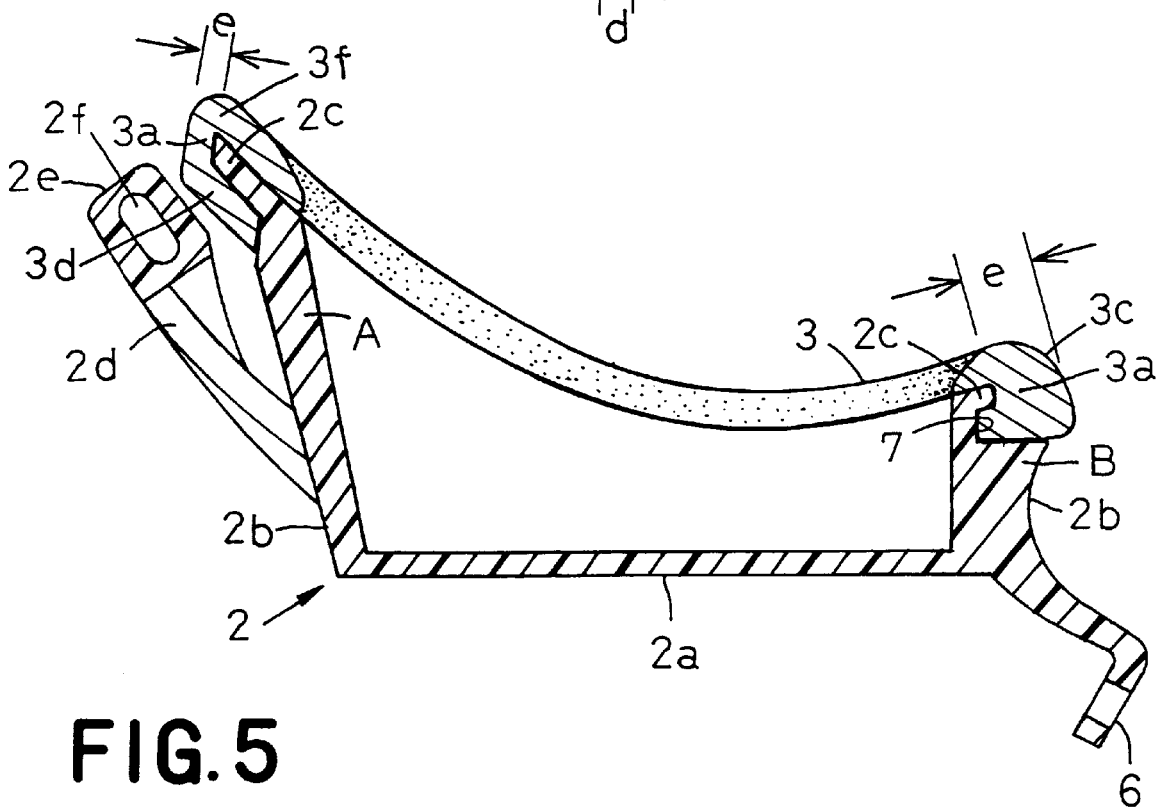
FIG.5

SWIMMING GOGGLES

BACKGROUND OF THE INVENTION

This invention relates to swimming goggles suitable for protection of a wearer's eyes.

Japanese Utility Model Application Laid-open No. 1994-48715 discloses swimming goggles having eye cups each including a peripheral wall formed on its outer surface with a peripheral groove circumferentially extending parallel to an entire rear edge of the peripheral wall. A wall portion defining a rear surface of the peripheral groove is used for attachment of a face-pad. The groove has a width dimensioned the to be substantially same as a thickness of a front edge of the pad adapted to be engaged with the peripheral groove. With the swimming goggles disclosed in Japanese Utility Model Application Laid-open No. 1994-48715, the front edge of the pad is engaged in the peripheral groove of the eye cup with a long rear skirt of the pad extending toward a face of a wearer of the goggles. The skirt of the pad will provide the goggles with a good cushioning effect, if the skirt deforms sufficiently as the goggles are worn. Although this effect is enhanced when the skirt is longer and flexible, the goggles tend to protrude from the face of the wearer and disturb a smooth flow of water along the face.

SUMMARY OF THE INVENTION

In view of the problem described above, it is a principal object of the invention to provide swimming goggles allowing such a problem to be effectively solved. In other words, the invention aims to provide swimming goggles with a face pad having a good cushioning effect and does not disturb the smooth flow of water along the face of the wearer.

The object set forth above is achieved, according to the invention, by swimming goggles comprising a pair of laterally symmetric lens members, a nose belt connecting the lens members between inner ends thereof adjacent a center line of the pair of lens members and a head band extending between line outer ends which are opposite the inner ends of the lens members.

Each of the lens members comprising a front lens, an annular peripheral wall extending rearward from a peripheral edge of the front lens, a flange locating along a rear end edge of the peripheral wall and extending radially outward of the peripheral wall, and a cushion pad detachably attached to the flange.

The peripheral wall, except in a region adjacent the outer end of the lens member, is gradually thickened rearward from the front lens so that, at a region spaced forward from a front surface of the flange by a predetermined distance, the peripheral wall has a height extending beyond a top of the flange and a first groove extending along the flange is formed between the thickened region and the flange.

Each of the pads comprises annular front and rear edges spaced from each other, and a bottom portion interposed between these two edges so as to define a second groove along an inner surface of the pad, the second groove of the pad being engaged with an entire periphery of the flange of the lens member so that the pad is exposed at the outer end of the lens member as viewed from the front of the lens member while, at least in an intermediate region between the inner and outer ends of the lens member, a bottom portion of the groove has a thickness substantially equal to or smaller than the height difference between the thickness of the peripheral wall and the height of the flange so that the pad is not exposed as viewed from the lens member.

According to an embodiment of the invention, the pad thickness of the bottom portion of the groove at the outer end of the lens member is larger than the corresponding thickness in the remaining region of the pad.

According to still another embodiment of the invention, the thickness of the bottom portion of the groove at the inner end of the lens member is larger than the difference between the thickness of the peripheral wall and the height of the flange.

BRIEF DESCRIPTION OF THE DRAWINGS

FIG. 4 is a sectional view taken along a line IV—IV in FIG. 1; and

FIG. 5 is a sectional view taken along a line V—V in FIG. 1.

DESCRIPTION OF THE PREFERRED EMBODIMENT

Details of swimming goggles 1 according to the invention will be more fully understood from the description given hereunder in reference with the accompanying drawings.

Figure 1:
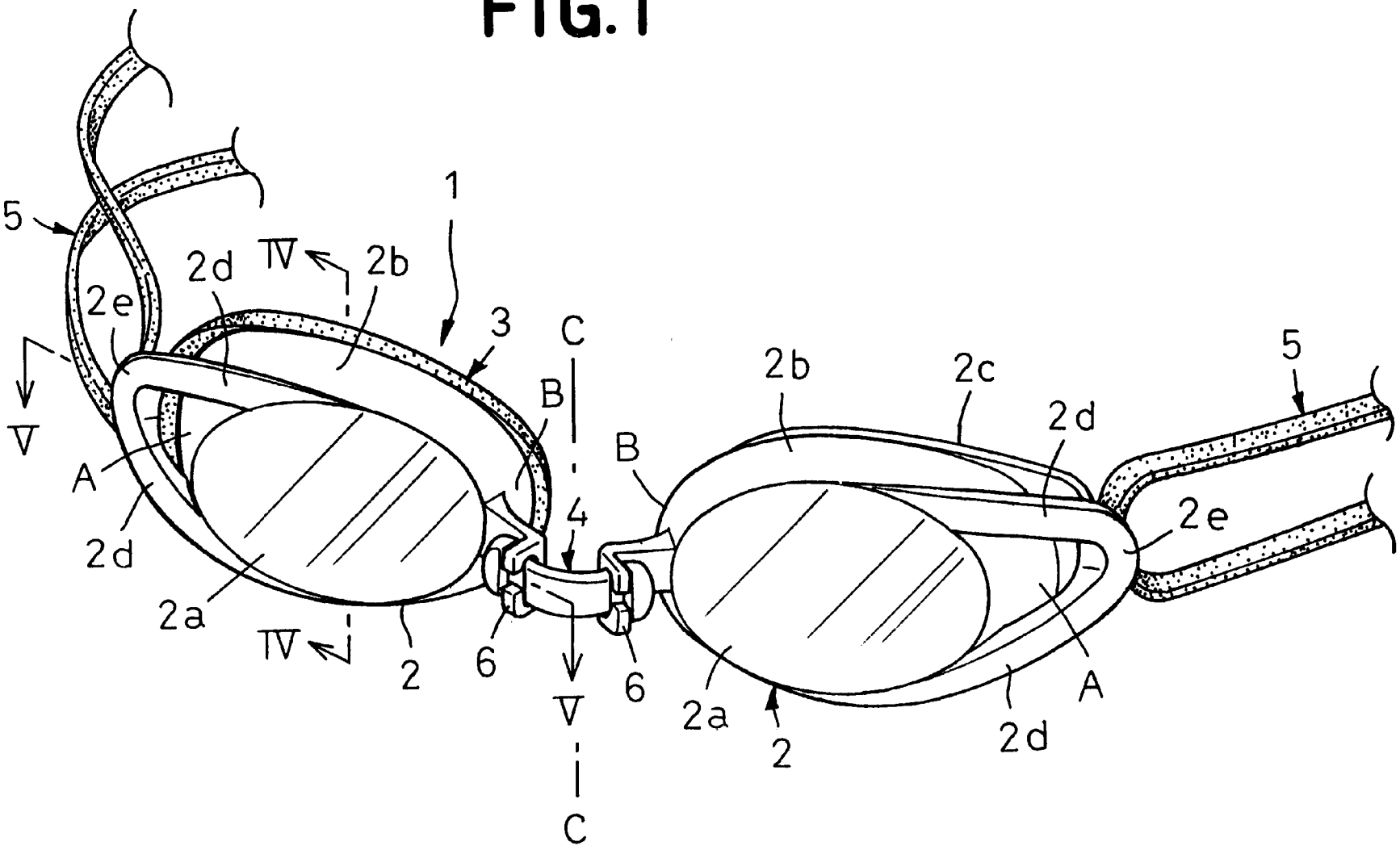
FIG. 1 is a partial perspective view of an embodiment of swimming goggles according to the invention.

FIG. 1 is a perspective view of the swimming goggles 1. It should be understood that FIG. 1 shows symmetrically paired right and left lens members 2, 2 as one of them being provided with a cushion pad 3 while the other being not provided with such a cushion pad 3. The right and left lens members 2, 2 are substantially identical to each other and designated by the same reference numerals 2, 2, respectively, so that these lens members 2, 2 will be described hereunder using a single reference numeral 2 designating each of these lens members 2, 2.

Referring to FIG. 1, the swimming goggles 1 has the lens member 2 made of synthetic resin such as transparent or translucent polycarbonate, a nose belt 4 connecting the pair of lens members 2 to each other between inner ends B located adjacent a center line C—C of the pair of the lens members, 2 and a head band 5 connecting the pair of lens members to each other.

The lens members 2 has a front lens 2*a* located on the front side of the goggles 1, an annular peripheral wall 2*b* extending rearward from a periphery of the front lens 2*a*, a flange 2*c* extending outward from a rear edge of the peripheral wall 2*b* radially of the peripheral wall 2*b*, a pair of arms 2*d* extending rearward from the peripheral wall 2*b*, and an annular cushion pad 3 made of soft elastic material and detachably mounted fully around a rear edge of the peripheral wall 2*b*.

The lens member 2 is provided on the inner end B with a support 6 for the nose belt 4 that 6 extends toward the center line C—C from a middle point in a vertical direction on the inner end B. The pair of arms 2*d* extend from points on upper and lower sides of the peripheral wall 2*b* adjacent their lateral middle points toward an outer end A which is opposite the inner end B on the peripheral wall 2*b*. These arms 2*d* join together to define an integral distal end 2*e* which is provided with a vertical hole 2*f* extending therethrough (see FIG. 2) for insertion of the head band 5.

Figure 2:
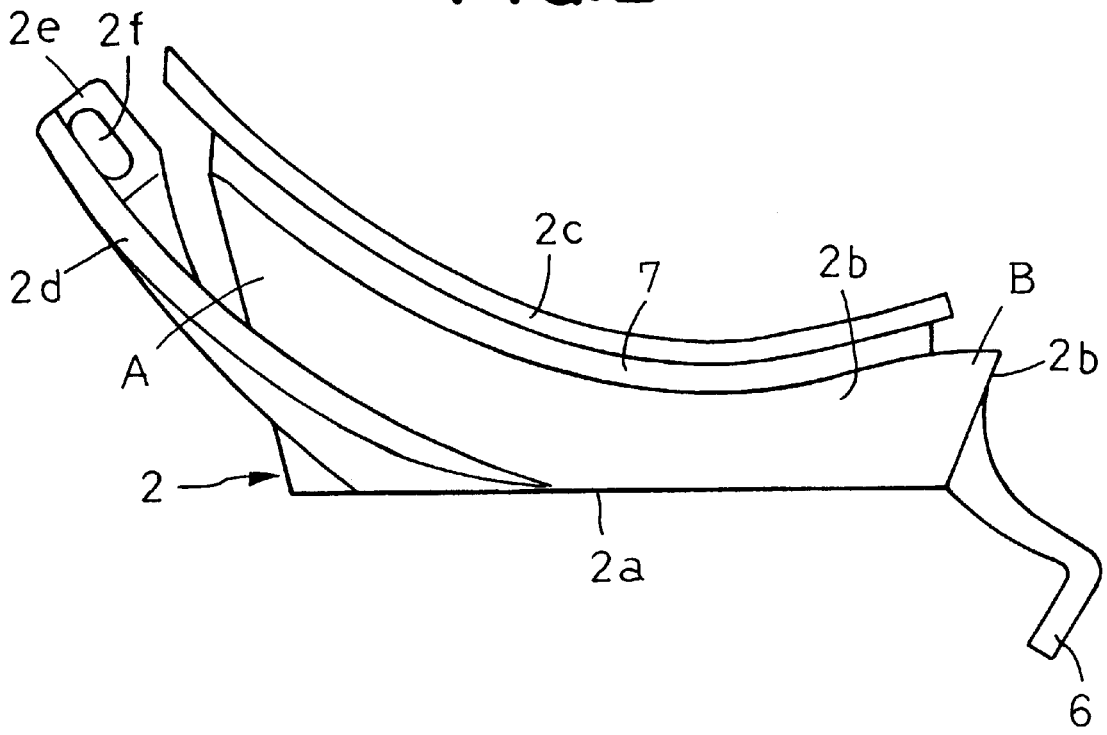
FIG. 2 is a side view of one of the lens members of the swimming goggles.

FIG. 2 is a top view of the lens member 2 of FIG. 1. It should be understood that the pad 3 is not shown for clarity of illustration.

Referring to FIG. 2, a rear edge of the peripheral wall 2*b* is curved between the outer end A and the inner end B and is in conformity with the configuration of a region between the inner- and outer-corners of the wearer's eye. Fully around the rear edge of the peripheral wall 2*b*, a flange 2*c* is formed to which the pad 3 will be attached. The arms 2*d* are curved toward the outer end A in parallel to the flange 2*c* and the distal end 2*e* of the arms 2*d* is spaced from the outer surface of the peripheral wall 2*b* by a predetermined distance.

Figure 3:
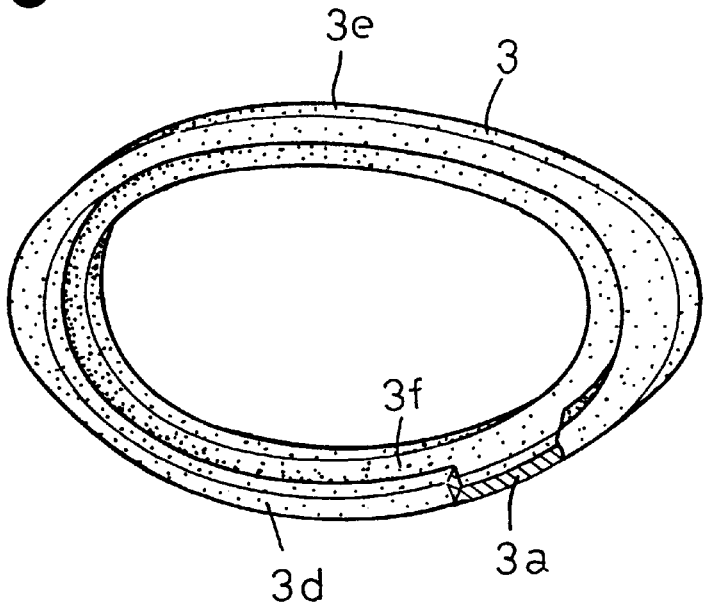
FIG. 3 is front view showing cushion pad as partially broken away.

FIG. 3 is a front view showing the pad 3 as partially broken away. Referring to FIG. 3, the pad 3 is formed along the entire inner surface with a groove so as to define front and rear edges 3*d*, 3*f* on front and rear sides of the pad 3 respectively. These front and rear edges 3*d*, 3*f* are connected by a bottom portion 3*a* of the groove. The rear edge 3*f* is adapted to contact the wearer's face. The thickness a bottom portion 3*a* is larger in a region adjacent the outer end A of the peripheral wall 2*b* than a region not in proximity of the outer end. Adjacent outer end A the pad 3 is exposed as viewed from the front of the lens members 2 (see FIGS. 1 and 5).

FIG. 4 is a sectional view taken along a line IV—IV in FIG. 1, in which the head band 5 is not shown for clarity of illustration. The peripheral wall 2*b* of the lens member 2 is gradually thickened rearward from the front lens 2*a* so that, at a region spaced forward from the front surface of the flange 2*c* by a predetermined distance d, the peripheral wall 2*b* has a thickness corresponding to a height extending outward beyond a top 2*h* of the flange 2*c* by a predetermined dimension. In order to attach the pad 3 to the lens member 2, the front edge 3*d* of the pad 3 is inserted into a groove 7 which is defined between the thickened peripheral wall 2*b* and the flange 2*c* and has a width d.

Referring to FIG. 4, a sum of the thickness e of the bottom portion 3*a* of the pad 3 and the height of the flange 2*c* is substantially equal to the thickness of the thickened peripheral wall 2*b*. More specifically, in intermediate regions of the peripheral wall 2*b* extending between the outer and inner ends A, B, a front edge 3*d* of the pad 3 is covered with the thickened peripheral wall 2*b* and therefore not exposed as viewed from front of the lens member 2. In this manner, an outer surface of the peripheral wall 2*b* is smoothly continuous with an outer surface 3*e* of the bottom portion 3*a* of the pad 3 without the formation of a step. This manner in which the outer surface 3*e* is connected to the outer surface of the peripheral wall 2*b* advantageously prevents water flow from being disturbed along these surfaces. Since the rear edge 3*f* of the pad 3 is relatively thin as shown in FIGS. 3 and 4, the goggles 1 do not protrude from the face of the wearer to disturb a smooth flow of water along the face FIG. 5 is a sectional view taken along line V—V in FIG. 1, in which the nose belt 4 as well as the head band 5 are not shown for clarity of illustration. At the outer end A, the thickness of the peripheral wall 2*b* decreases so that the groove 7 disappears and the front edge 3*d* of the pad 3 is exposed as viewed from the front of lens member 2. When the swimming goggles 1 are worn, the wearer's face is pressed against the rear edge 3*f* of the pad 3. The thickness e of the pad 3 in the bottom portion 3*a* at the outer end A is dimensioned to be relatively large to provide a soft contact with the face.

The thickness e of the pad 3 in the bottom portion 3*a* at the inner end B is larger than the thickness of the peripheral wall 2*b* so that the pad 3 partially extends outward beyond the peripheral wall 2*b*. A part of the pad 3 thus extending outward beyond the peripheral wall 2*b* is relatively free from restriction by the peripheral wall 2*b* and therefore provides a relatively high cushioning effect. It should be understood that the invention is not limited to such a design that the thickness e of the pad 3 at the inner end B is dimensioned to be relatively large.

With the swimming goggles according to the invention, a high cushioning effect of the pad is achieved since the pad is elastically deformable at the outer end of each lens member with a relatively high freedom.

What is claimed is:

1. Swimming goggles comprising:

a pair of laterally symmetric lens members each including a front lens, an annular peripheral wall extending rearward along a peripheral edge of the front lens, a flange located along a rear end edge of the peripheral wall and extending outward radially of the peripheral wall, a first groove formed between the peripheral wall and the flange, and a cushion pad detachably attached to the flange;

a nose belt connecting the lens members between inner edges thereof; and a head band extending between outer ends of the lens members which are opposite to the inner edges; wherein:

said peripheral wall, except in a region adjacent the outer end of the lens member, has a height extending beyond a top of the flange at a region defined between a rear edge of the peripheral wall and the first groove, each of the pads includes an annular front edge spaced from an annular rear edge, and a bottom interposed between the front and rear edges to define a second groove along an inner surface of the pad, the second groove being engaged with an entire periphery of the flange so that the pad is exposed at the outer end of the lens member as viewed from the front of the lens while a portion defined between the bottom of the second groove and an outer surface of the pad opposed to the bottom of the second groove in an intermediate region between the inner and outer ends of the lens member, has a thickness substantially equal to or smaller than a height difference between a thickness of the peripheral wall and the height of the flange.

2. The swimming goggles according to claim 1, wherein the region of the peripheral wall defined between the rear edge of the peripheral wall and the first groove, except in a region adjacent the outer end of the lens member, is gradually thickened rearward from the front lens.

3. The swimming goggles according to claim 1, wherein a portion defined between the bottom of the second groove of the pad of an outer surface of the pad opposed to the bottom of the second groove at the outer end of the lens member has a thickness larger than a corresponding thickness at the intermediate region between the inner and outer ends of the lens member.

4. The swimming goggles according to claim 1, wherein a portion defined between the bottom of the second groove of the pad and an outer surface of the pad opposed to the bottom of the second groove at the inner end of the lens member has a thickness larger than a corresponding thickness at the intermediate region between the inner and outer edges of the lens member.

* * * * *